US011313263B2

(12) United States Patent
Salemme

(10) Patent No.: US 11,313,263 B2
(45) Date of Patent: Apr. 26, 2022

(54) SYSTEMS AND METHODS FOR HEATING AN AFTERTREATMENT SYSTEM

(71) Applicant: Cummins Inc., Columbus, IN (US)

(72) Inventor: Gary C. Salemme, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 16/915,211

(22) Filed: Jun. 29, 2020

(65) Prior Publication Data

US 2021/0404362 A1 Dec. 30, 2021

(51) Int. Cl.

| | |
|---|---|
| ***F01N 3/20*** | (2006.01) |
| ***F02B 37/00*** | (2006.01) |
| ***F01N 5/04*** | (2006.01) |
| ***F02B 33/44*** | (2006.01) |

(52) U.S. Cl.

CPC ..... *F01N 3/2013* (2013.01); *F01N 3/2006* (2013.01); *F01N 3/208* (2013.01); *F01N 5/04* (2013.01); *F02B 33/443* (2013.01); *F02B 37/005* (2013.01); *F01N 3/2066* (2013.01); *F01N 2550/02* (2013.01); *F01N 2550/04* (2013.01)

(58) Field of Classification Search

CPC ..... F01N 3/2013; F01N 3/2006; F01N 3/208; F01N 5/04; F01N 2550/04; F01N 2550/02; F01N 3/2066; F02B 33/443; F02B 37/005

See application file for complete search history.

(56) References Cited

U.S. PATENT DOCUMENTS

| | | | | |
|---|---|---|---|---|
| 6,637,204 | B2 | 10/2003 | Ellmer et al. | |
| 9,388,722 | B2 | 7/2016 | Gonze et al. | |
| 9,562,452 | B2 | 2/2017 | Gonze et al. | |
| 9,771,847 | B2 | 9/2017 | Van Niekerk et al. | |
| 2006/0021346 | A1* | 2/2006 | Whelan | F02D 9/04 60/605.2 |
| 2018/0291827 | A1* | 10/2018 | Disaro' | F01N 3/2066 |
| 2018/0340480 | A1* | 11/2018 | Mehta | F02D 41/024 |
| 2020/0109675 | A1* | 4/2020 | Han | B60W 10/06 |

FOREIGN PATENT DOCUMENTS

| | | | |
|---|---|---|---|
| DE | 102015221503 A1 | 5/2017 | |
| WO | WO-2015092180 A2 * | 6/2015 | F02M 26/13 |

OTHER PUBLICATIONS

Machine Translation of WO-2015092180-A2 (Year: 2015).*

* cited by examiner

*Primary Examiner* — Brandon D Lee

(74) *Attorney, Agent, or Firm* — Faegre, Drinker, Biddle & Reath LLP

(57) ABSTRACT

A method for warming an aftertreatment system of an engine system while an engine of the engine system is not running comprising starting at least one of an electric compressor and an electric heater using stored electrical energy and passing air through the engine system to at least a portion of the aftertreatment system when the engine of the engine system is not running.

4 Claims, 3 Drawing Sheets

SYSTEMS AND METHODS FOR HEATING AN AFTERTREATMENT SYSTEM

TECHNICAL FIELD OF THE DISCLOSURE

The present disclosure relates to systems and methods for heating an aftertreatment system, and specifically to systems and methods for heating an aftertreatment system while the engine is not running or by circumventing the engine while it is running.

BACKGROUND OF THE DISCLOSURE

In engine systems with internal combustion engines and aftertreatment systems, the aftertreatment systems must be warm for emissions to be treated or converted. However, current systems are unable to warm up aftertreatment systems without the engine running such that fuel is burned and emissions are created while the aftertreatment system is not at a sufficient temperature. This results in a period of emissions that cannot be treated prior to leaving the engine system. Thus, a system and method for heating an aftertreatment system while the engine is not running or by circumventing the engine when it is running to heat up the aftertreatment system faster is needed.

SUMMARY OF THE DISCLOSURE

In one embodiment of the present disclosure, a method for warming an aftertreatment system of an engine system while an engine of the engine system is not running is provided. The method comprises starting the electric compressor using stored electrical energy and passing air through an exhaust gas recirculation system of the engine system to at least a portion of the aftertreatment system, wherein the air is passed in a direction opposite to a direction of exhaust flow through the exhaust gas recirculation system when the engine of the engine system is running.

In another embodiment of the present disclosure, a method for warming an aftertreatment system of an engine system while an engine of the engine system is not running, where the engine system includes at least one of an electric compressor and an electric heater is provided. The method includes starting the at least one of the electric compressor and the electric heater using stored electrical energy and passing air to at least a portion of the aftertreatment system through an engine bypass channel when the engine is not running.

In a further embodiment of the present disclosure, a method for warming an aftertreatment system of an engine system while an engine of the engine system is not running, where the engine system includes at least one of an electric compressor and an electric heater is provided. The method comprises starting the at least one of the electric compressor and the electric heater using stored electrical energy and passing air to at least a portion of the aftertreatment system through at least one valve of at least one cylinder of the engine when the engine is not running.

BRIEF DESCRIPTION OF THE DRAWINGS

Advantages and features of the embodiments of this disclosure will become more apparent from the following detailed description of exemplary embodiments when viewed in conjunction with the accompanying drawings, wherein.

Figure 1:
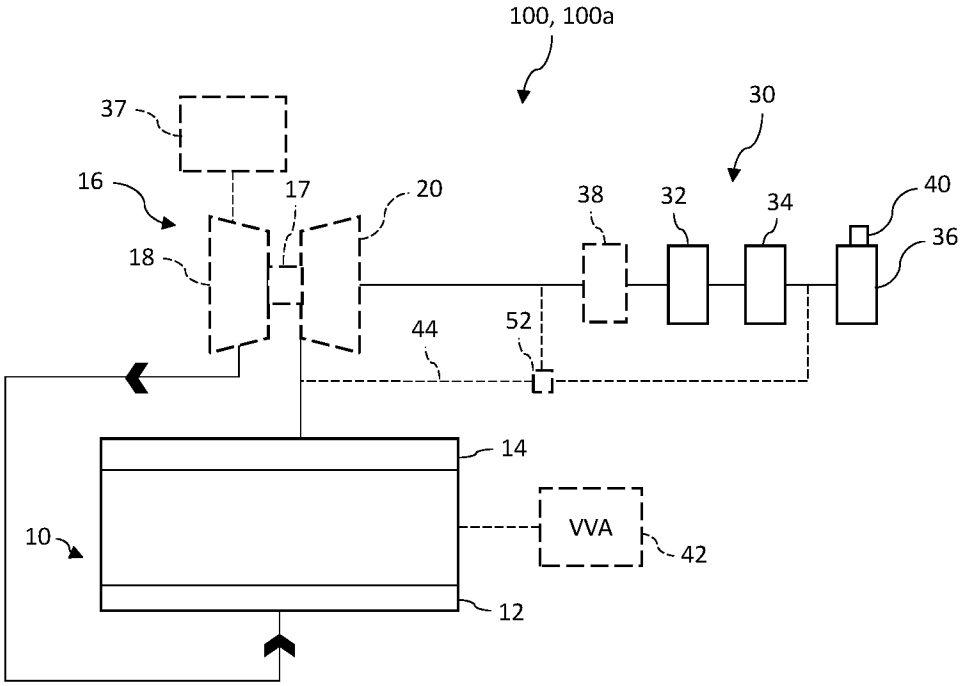
FIG. 1 shows a schematic diagram of a first embodiment of an engine system of the present disclosure configured to heat an aftertreatment system of the engine system when the engine is not running.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the disclosure, in one form, and such exemplifications are not to be construed as limiting the scope of the disclosure in any manner.

DETAILED DESCRIPTION OF THE DRAWINGS

Figure 2:
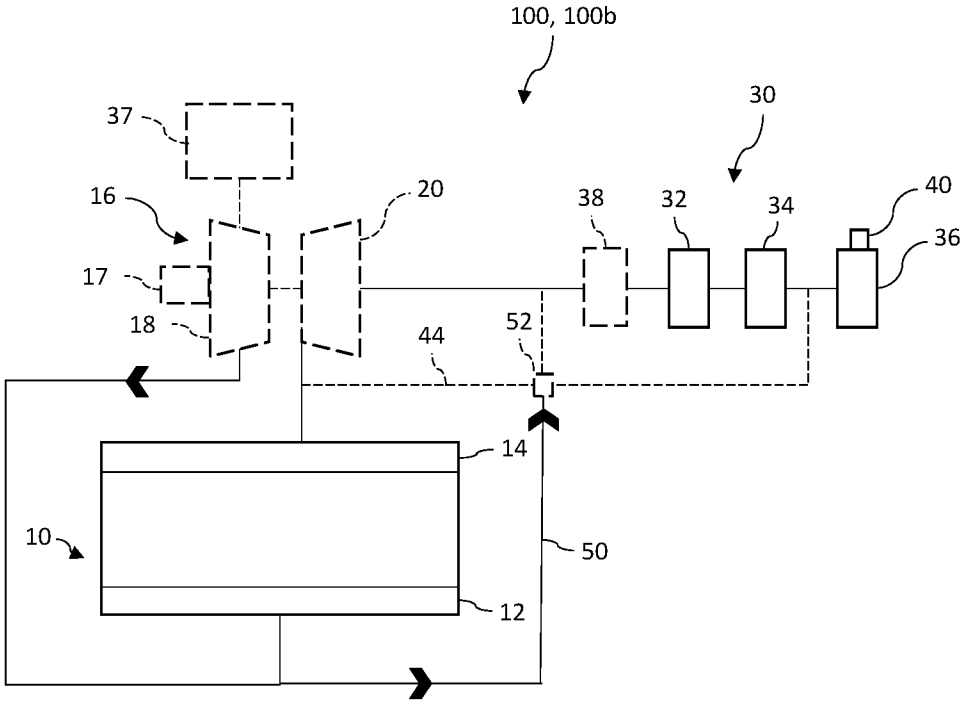
FIG. 2 shows a schematic diagram of a second embodiment of an engine system of the present disclosure configured to heat an aftertreatment system of the engine system when the engine is not running.
Figure 3:
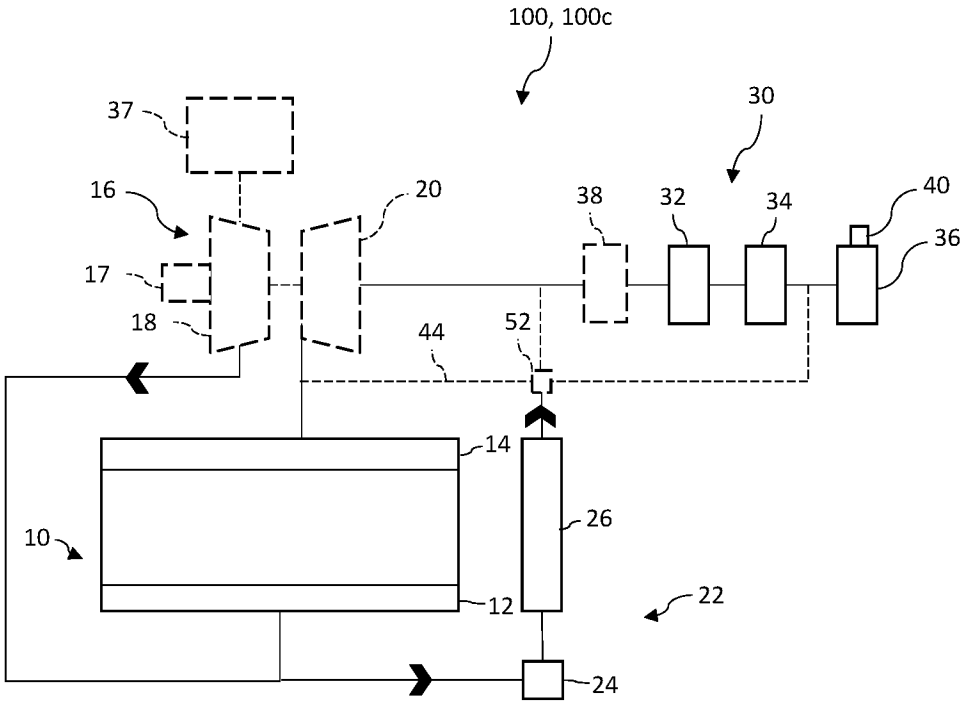
FIG. 3 shows a schematic diagram of a third embodiment of an engine system of the present disclosure configured to heat an aftertreatment system of the engine system when the engine is not running.

Referring now to FIGS. 1-3, a schematic diagram of an engine system 100 is shown. Engine system 100 generally comprises an engine 10, which includes an intake 12 and an exhaust 14, and an aftertreatment system 30, which may comprise a diesel oxidation catalyst (DOC) 32, a diesel particulate filter (DPF) 34, and/or a selective catalytic reduction (SCR) system 36. Engine system 100 may further include a turbocharger 16 having a compressor 18 and a turbine 20, an electric compressor 37, and/or an electric heater 38. For example, engine system 100 may include each of turbocharger 16, electric compressor 37, and electric heater 38, while in other various embodiments, engine system 100 may only include turbocharger 16 and electric heater 38 or compressor 37 and electric heater 38 or compressor 37 or turbocharger 16 alone. In various embodiments, turbocharger 16 is an electric turbocharger including a motor 17, and compressor 18 is an electric compressor. Motor 17 of electric turbocharger 17 may be coupled between compressor 18 and turbine 20 (FIG. 1) or to compressor 18 alone (FIG. 2). Motor 17 of electric turbocharger 16 (and therefore compressor 18 and/or turbine 20), electric compressor 37, and/or electric heater 38 may run off stored electrical energy from an electrical system containing a battery (not shown) while engine 10 is not running. Turbocharger 16 and/or electric compressor 37 are generally configured to move air through engine system 100 when engine 10 is not running, while heater 38 is configured to heat air passed through heater 38.

Furthermore, in various embodiments, SCR system 36 is coupled to an injector 40 configured to provide diesel exhaust fluid (DEF), ammonia (NH3), or another reactant to SCR system 36. Injector 40 may be controlled such that SCR system 36 is preloaded with DEF, NH3, or another reactant while engine 10 is not running.

Engine system 100 generally also includes an engine control module (ECM) (not shown) that is configured to control the various components of engine system 100. For instance, the ECM may be configured to understand a need for engine 10 to be started up, to determine a temperature of aftertreatment system 30, to determine an amount of electrical energy available to run the various components of system 100 such as turbocharger 16, electric heater 38 and/or injector 40, and to determine when the various components of system 100 such as turbocharger 16, electric heater 38, and/or injector 40 should be turned on to properly heat aftertreatment system 30 prior to igniting engine 10. The ECM may further be configured to determine when to open the cylinder valves or other valves of system 100 described further below for driving air through the cylinders or other component of system 100 or when to stop engine 10 such that the valves of the cylinders overlap.

With reference to FIG. 1, a first embodiment 100*a* of engine system 100 is shown that is configured to heat aftertreatment system 30 while engine 10 is not running. Engine system 100*a* allows air to enter through compressor 18 of turbocharger 16 and/or electric compressor 37, and to flow through cylinders of engine 10 while engine 10 is not running such that the air can flow to aftertreatment system 30. In various embodiments, air may flow through the cylinder(s) of engine 10 by controlling the valves of the cylinder(s) via the ECM to overlap when engine 10 is shut down previously. In other various embodiments, engine system 100*a* may further include a variable valve system 42 configured to open the valve(s) of the cylinder(s) to allow air through. Variable valve system 42 may include an oil accumulator or a piezo system to allow the valves to be opened while engine 10 is not running. In various embodiments, once air passes through the cylinder(s) of engine 10, this air may flow through turbine 20 of turbocharger 16 and then to aftertreatment system 30, or flow around or bypass turbine 20 of turbocharger 16 via bypass channel 44 and go directly to aftertreatment system 30.

Referring now to FIG. 2, a second embodiment 100*b* of engine system 100 is shown that is configured to heat aftertreatment system 30 while engine 10 is not running or while engine 10 is running off of electrical energy prior to burning any fuel. Engine system 100*b* includes an engine bypass 50 configured to allow air received from compressor 18 of turbocharger 16 and/or electric compressor 37 to route past engine 10 and either flow through turbine 20 of turbocharger 16 or bypass turbocharger 16 via bypass channel 44 and flow to aftertreatment system 30.

With reference now to FIG. 3, a third embodiment 100*c* of engine system 100 is shown that is configured to heat aftertreatment system 30 while engine 10 is not running. Engine system 100*c* further includes an exhaust gas recirculation (EGR) system 22 having an EGR valve 24 and an EGR cooler 26. In various embodiments, EGR valve 24 may be upstream of EGR cooler 26, while in other various embodiments, EGR valve 24 may be downstream of EGR cooler 26. Engine system 100*c* is configured to route air backwards through EGR system 22 such that the air received from compressor 18 of turbocharger 16 and/or electric compressor 37 bypasses engine 10 and either flows through turbine 20 of turbocharger 16 or bypasses turbocharger 16 and flows to aftertreatment system 30. In other words, engine system 100*c* routes air through EGR system 22 in a direction opposite to the direction of exhaust flow through EGR system 22 when engine 10 is running.

When turbine 20 is bypassed via bypass channel 44 or air flows from engine bypass 50 to aftertreatment system 30 bypassing turbocharger 16, this air may flow to a position upstream of DOC 32, DPF 34 and/or SRC system 36 or to a position downstream of DOC 32, and DPF 34 just upstream of or directly to SRC system 36, or to any position therebetween. Heater 38 may be positioned at any position within engine system 100. For example, heater 38 may be positioned upstream of DOC 32, DPF 34, and SRC system 36, or heater 38 may be positioned downstream of DOC 32 and DPF 34 and upstream of SRC system 36. Bypass channel 44 may include a valve 52 configured to direct air to the various positions of aftertreatment system 30.

In various embodiments, engine system 100 may further include an electric motor (not shown) such that engine system 100 is a hybrid system. The electric motor may provide mechanical power to or absorb mechanical power from engine 10 in exchange for using or providing electrical energy to the electrical system of engine system 100, which may be configured to run compressor 18 and/or turbine 20 of turbocharger 16, compressor 37, heater 38, and/or other various components of engine system 100 off of stored electrical energy. For instance, electric energy provided to the electrical system of engine system 100 from the electric motor may run motor 17 of turbocharger 16, compressor 37, and/or heater 38 such that aftertreatment system 30 may be warmed up prior to any fuel being burned through the running of engine 10 from power produced by a fuel.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method for warming an aftertreatment system of an engine system while an engine of the engine system is not running, the engine system including an electric compressor, the method comprising:

starting the electric compressor using stored electrical energy;

passing air through an exhaust gas recirculation system of the engine system to at least a portion of the aftertreatment system, wherein the air is passed in a direction opposite to a direction of exhaust flow through the exhaust gas recirculation system when the engine of the engine system is running;

wherein the electric compressor is part of a turbocharger that further includes a turbine, and the air passed through the exhaust gas recirculation system is allowed to bypass the turbine via a turbine bypass channel, wherein the turbine bypass channel includes a valve configured to direct air to the various positions of the aftertreatment system, and wherein the aftertreatment system includes a diesel oxidation catalyst (DOC), a diesel particulate filter (DPF), and a selective catalytic reduction (SCR) system, and the valve is configured to direct air passed through the exhaust gas recirculation system to a position upstream of the DOC, the DPF, and the SCR system, and an another position upstream of the SCR system and downstream of the DOC and the DPF.

2. The method of claim 1, wherein the electric compressor is part of a turbocharger that further includes a turbine, and the air passed through the exhaust gas recirculation system is passed through the turbine.

3. The method of claim 1, wherein the engine system further includes an electric heater positioned between the exhaust gas recirculation system and the aftertreatment system, and the method further comprises starting the electric heater using stored electrical energy and passing the air through the electric heater prior to the air being passed to the portion of the aftertreatment system.

4. The method of claim 1, wherein the valve is further configured to direct air to the turbine.

* * * * *